US009185973B2

(12) United States Patent
Udagawa et al.

(10) Patent No.: US 9,185,973 B2
(45) Date of Patent: Nov. 17, 2015

(54) CHAIR AND A METHOD OF USING THE CHAIR

(71) Applicants: Masamichi Udagawa, New York, NY (US); Sigrid Moeslinger, New York, NY (US); Hendrik R. van Hekken, Allentown, PA (US)

(72) Inventors: Masamichi Udagawa, New York, NY (US); Sigrid Moeslinger, New York, NY (US); Hendrik R. van Hekken, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 32 days.

(21) Appl. No.: 13/775,766

(22) Filed: Feb. 25, 2013

(65) Prior Publication Data

US 2013/0221710 A1 Aug. 29, 2013

Related U.S. Application Data

(60) Provisional application No. 61/604,816, filed on Feb. 29, 2012.

(51) Int. Cl.

| | |
|---|---|
| ***A47B 39/00*** | (2006.01) |
| ***A47B 39/10*** | (2006.01) |
| ***A47B 83/02*** | (2006.01) |
| ***A47C 7/40*** | (2006.01) |
| ***A47C 7/68*** | (2006.01) |
| ***A47B 39/08*** | (2006.01) |

(52) U.S. Cl.

CPC ..... *A47B 83/02* (2013.01); *A47B 39/08* (2013.01); *A47B 39/10* (2013.01); *A47C 7/40* (2013.01); *A47C 7/68* (2013.01)

(58) Field of Classification Search

USPC ..... 297/172, 174 R, 452.21, 171, 297/135–174 CS, 170; D6/335, 336, 337, D6/338

See application file for complete search history.

(56) References Cited

U.S. PATENT DOCUMENTS

| | | | | | |
|---|---|---|---|---|---|
| 411,553 | A | | 9/1889 | Manning | |
| 719,338 | A | | 1/1903 | Karpen | |
| 1,691,053 | A | | 11/1928 | Ferris | |
| 2,102,261 | A | * | 12/1937 | Fotre | 297/423.14 |
| 2,162,560 | A | * | 6/1939 | Larsen | 297/171 |
| D145,779 | S | * | 10/1946 | Davis | D6/338 |
| D148,956 | S | * | 3/1948 | Rhodes | D6/338 |
| 2,459,257 | A | * | 1/1949 | Wood | 297/172 |
| 2,486,468 | A | * | 11/1949 | Freedman | 297/156 |

(Continued)

FOREIGN PATENT DOCUMENTS

| | | |
|---|---|---|
| DE | 2050322 A1 | 4/1972 |
| DE | 9102851 U1 | 7/1991 |

(Continued)

OTHER PUBLICATIONS

International Search Report for PCT/US2013/027711 dated Jun. 6, 2013.

(Continued)

*Primary Examiner* — Rodney B White

(74) *Attorney, Agent, or Firm* — Buchanan Ingersoll & Rooney PC

(57) ABSTRACT

A chair includes a tablet and a seat. The tablet and seat are configured such that a user may sit forwardly on the seat so that his or her arms may rest on the tablet and a device or paper may be positioned on the tablet such that the person may look at the device or paper. The tablet and seat are also arranged such that the person may sit rearwardly on the seat so that the person's back rests on a bottom portion of the tablet.

20 Claims, 6 Drawing Sheets

(56) References Cited

U.S. PATENT DOCUMENTS

| | | | | | |
|---|---|---|---|---|---|
| D156,695 | S | * | 1/1950 | Brafman | 297/172 X |
| D159,975 | S | * | 9/1950 | Gilkinson | 297/172 X |
| D159,992 | S | * | 9/1950 | Kump, Jr. | D6/338 |
| D169,012 | S | * | 3/1953 | Musacco | 297/172 X |
| D170,005 | S | | 7/1953 | Chapman et al. | |
| D170,331 | S | | 9/1953 | Moore | |
| 2,661,049 | A | * | 12/1953 | Sebel | 297/172 |
| 2,673,595 | A | * | 3/1954 | Kump, Jr. | 297/172 |
| 2,675,859 | A | * | 4/1954 | Abler | 297/124 |
| 2,702,584 | A | * | 2/1955 | Williams et al. | 297/124 |
| 2,732,007 | A | * | 1/1956 | MacWhirter | 297/172 |
| 2,758,633 | A | * | 8/1956 | Apple | 297/124 |
| D178,989 | S | * | 10/1956 | Eilert | D6/338 |
| 2,856,985 | A | * | 10/1958 | Lepper | 297/124 |
| D184,151 | S | * | 12/1958 | Schneider | D6/338 |
| 2,897,876 | A | * | 8/1959 | Austin | 297/31 |
| 3,020,086 | A | | 2/1962 | Barber | |
| 3,077,038 | A | * | 2/1963 | Williams et al. | 434/310 |
| D195,457 | S | * | 6/1963 | Ingram | D6/340 |
| 3,127,170 | A | * | 3/1964 | Caster | 472/14 |
| 3,156,498 | A | | 11/1964 | Blodee | |
| 3,350,133 | A | | 10/1967 | Schaefer | |
| 3,361,470 | A | * | 1/1968 | Erickson et al. | 297/124 |
| 3,420,571 | A | * | 1/1969 | Moore | 297/124 |
| 3,467,432 | A | | 9/1969 | Sullivan | |
| D216,724 | S | * | 3/1970 | Sherman | D6/338 |
| D226,066 | S | * | 1/1973 | Barecki | D6/338 |
| 4,023,859 | A | * | 5/1977 | Hagenson | 297/463.1 |
| 4,203,624 | A | | 5/1980 | Hopkins | |
| D265,441 | S | * | 7/1982 | Menashe | D6/340 |
| D265,612 | S | * | 8/1982 | Gusrud et al. | D6/373 |
| 4,482,185 | A | * | 11/1984 | Zoellner | 297/135 |
| 4,529,247 | A | | 7/1985 | Stumpf et al. | |
| D283,378 | S | * | 4/1986 | Opsvik | D6/366 |
| D283,563 | S | * | 4/1986 | Arroyo | D6/338 |
| D292,453 | S | * | 10/1987 | Opsvik | D6/335 |
| D292,756 | S | * | 11/1987 | Opsvik | D6/335 |
| D292,853 | S | * | 11/1987 | Opsvik | D6/335 |
| D295,119 | S | * | 4/1988 | Gusrud | D6/330 |
| 4,738,484 | A | * | 4/1988 | Leong | 297/172 X |
| D296,959 | S | * | 8/1988 | Gusrud | D6/330 |
| 4,801,175 | A | * | 1/1989 | Albanese | 297/124 |
| 4,921,302 | A | * | 5/1990 | Godwin | 297/170 |
| D322,178 | S | * | 12/1991 | Pons | D6/338 |
| 5,271,175 | A | * | 12/1993 | West, III | 42/94 |
| 5,292,172 | A | * | 3/1994 | Watts et al. | 297/127 |
| D348,568 | S | * | 7/1994 | Landry | D6/330 |
| 5,378,037 | A | * | 1/1995 | Beasley et al. | 297/174 R |
| D357,590 | S | * | 4/1995 | Noll | D6/337 |
| 5,474,356 | A | * | 12/1995 | Johnson | 297/156 |
| 5,692,799 | A | * | 12/1997 | Sheets | 297/124 |
| D398,452 | S | * | 9/1998 | Reddig | D6/338 |
| 5,820,208 | A | * | 10/1998 | Miklinevich | 297/159.1 |
| 5,876,093 | A | * | 3/1999 | Williams | 297/174 R |
| 5,931,528 | A | | 8/1999 | Shields | |
| D415,361 | S | * | 10/1999 | Moreau | D6/349 |
| 5,988,738 | A | * | 11/1999 | Blessing et al. | 297/141 |
| 6,010,186 | A | * | 1/2000 | Tsay | 297/159.1 |
| 6,039,392 | A | * | 3/2000 | Dencker | 297/172 |
| 6,102,475 | A | | 8/2000 | Hamann | |
| 6,189,965 | B1 | * | 2/2001 | Hecht et al. | 297/124 |
| 6,231,121 | B1 | * | 5/2001 | Chrisco et al. | 297/124 |
| D447,640 | S | * | 9/2001 | Ranspach | D6/338 |
| 6,302,032 | B1 | * | 10/2001 | Ranspach | 108/12 |
| D469,615 | S | * | 2/2003 | Noll | D6/337 |
| D473,387 | S | * | 4/2003 | Noll | D6/337 |
| D475,207 | S | * | 6/2003 | Bosman et al. | D6/338 |
| 6,604,784 | B1 | * | 8/2003 | Bosman et al. | 297/171 |
| 6,857,696 | B2 | * | 2/2005 | Usagani | 297/1 |
| 6,874,429 | B2 | * | 4/2005 | Bosman et al. | 108/59 |
| 6,878,026 | B2 | * | 4/2005 | Cloutier | 441/130 |
| 6,883,763 | B2 | * | 4/2005 | Bosman et al. | 248/188.9 |
| D505,022 | S | | 5/2005 | Mills et al. | |
| D521,750 | S | * | 5/2006 | Glass et al. | D6/336 |
| 7,059,670 | B2 | | 6/2006 | Mills et al. | |
| D589,725 | S | | 4/2009 | Adams et al. | |
| D609,506 | S | * | 2/2010 | Adams et al. | D6/716 |
| 7,954,892 | B2 | * | 6/2011 | Knighton | 297/142 |
| 8,029,060 | B2 | | 10/2011 | Parker et al. | |
| D649,368 | S | * | 11/2011 | Benden | D6/338 |
| D685,585 | S | * | 7/2013 | Udagawa et al. | D6/338 |
| 8,720,990 | B2 | * | 5/2014 | Boydston | 297/173 |
| 8,919,873 | B1 | * | 12/2014 | Gonzalez | 297/163 |
| 2003/0230914 | A1 | | 12/2003 | Bosman et al. | |
| 2009/0273214 | A1 | * | 11/2009 | Shields et al. | 297/239 |

FOREIGN PATENT DOCUMENTS

| | | | |
|---|---|---|---|
| DE | 202012000062 | U1 | 3/2012 |
| EP | 0309021 | A1 | 3/1989 |
| FR | 1267168 | A | 7/1961 |
| GB | 2228190 | A | 8/1990 |

OTHER PUBLICATIONS

Written Opinion of the International Searching Authority for PCT/US2013/027711 dated Jun. 6, 2013.

* cited by examiner

CHAIR AND A METHOD OF USING THE CHAIR

CROSS-REFERENCE TO RELATED APPLICATIONS

The present application claims priority to U.S. Provisional Patent Application No. 61/604,816, which was filed on Feb. 29, 2012.

FIELD OF INVENTION

The present invention relates to chairs and methods of using a chair.

BACKGROUND OF THE INVENTION

Chairs often include a base that supports a seat. The base may also support a backrest in some chair designs. The backrest may recline. Examples of such chair designs may be appreciated from U.S. Pat. No. 8,029,060.

Some chairs are configured as a tablet chair. Such chairs often include a base that supports both a seat and a tablet. The tablet may be a planar surface that is supported in front of and above a seat so that a person sitting in the seat of the chair may read a document on the tablet, use a device on the tablet, write notes on paper supported by the tablet or perform other types of work on the tablet. Examples of tablet chair designs may be appreciated from U.S. Pat. Nos. 7,059,670, 6,102,475, 5,931,528, 4,529,247, 4,203,624, 3,467,432, 3,156,498, 3,020,086, 1,691,053, 719,338, 411,553, D589,725, D505,022, D170,331, and D170,005 and U.S. Patent Application Publication No. 2003/0230914.

Typically, tablet chair designs fail to permit a user to have multiple different seating options. For example, such chairs are usually designed to require a user to sit facing forwardly by facing the desk or tablet of the chair. Prolonged sitting in such an arrangement, however, may be uncomfortable or undesirable to a user. We have determined that a new chair design is needed that may permit a user to sit in a chair multiple ways so that the chair may be more easily and acceptably used in various different settings and permit multiple different organizational arrangements for purposes of collaboration, participating in meetings, or otherwise performing work.

SUMMARY OF THE INVENTION

A chair includes a tablet and a seat. The tablet and seat may be configured such that a user may sit forwardly on the seat so that his or her arms may rest on the tablet and a device, paper, or other material may be positioned on the tablet such that the person may look at the device or paper or perform work on the surface of the tablet. The tablet and seat are also arranged such that the person may sit rearwardly on the seat so that the person's back rests on a downwardly projecting bottom portion of the tablet.

In some embodiments of the chair, the bottom portion of the tablet may be immediately adjacent a downwardly curved portion of the tablet that may function as an upper surface for supporting a user's back when the user is seated rearwardly. The seat may also have a curved bottom portion for providing a surface for supporting an upper portion of a user's legs when the user is seated rearwardly.

A method of using the chair is also provided. The method may include a user sitting on the chair forwardly and subsequently turning around on the seat to sit on the seat rearwardly so that the user's back rests on the bottom portion of the tablet and legs rest upon or engage a downwardly projecting bottom portion of the seat.

In one embodiment of the chair, the chair includes a base, a seat supported by the base, and a tablet supported by the base. The tablet is above and forward of the seat (e.g. in front of the seat). The tablet has an upper front edge, a bottom rear edge, and a curved portion between the front edge and the bottom rear edge. The curved portion of the tablet may extend upwardly from adjacent the rear bottom edge to a position adjacent to a front portion of the tablet.

The seat may have a number of different configurations. In some embodiments, the seat may have a front edge and a rear edge. The rear edge of the seat may be lower than the front edge of the seat. The seat can also have a curved portion between the rear edge of the seat and the front edge of the seat. The curved portion of the seat can extend upwards from the rear edge of the seat to define a curved surface of the seat. In addition, the curved portion of the tablet may extend from the rear edge of the tablet to the front portion of the tablet to define a curved surface of the tablet.

The base of the chair can include a number of different designs or arrangements. For instance, the base may include at least one sled member. For example, the base may include a first sled member and a second sled member. The first and second sled members may support both the seat and the tablet. The first sled member may have a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a first side of the seat or attachment to the first side of the seat. The second sled member may have a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a second side of the seat or attachment to the second side of the seat, the second side of the seat being opposite the first side of the seat. In some embodiments of the chair, the horizontal and front vertical members of the first and second sled members may be sized and configured to define space between the horizontal and front vertical members of the first and second sled members. The space may be sized and configured to provide an opening for a user's feet when the user sits on the seat so that a chest of the user faces toward the tablet. The rear vertical member of the first sled member may be positioned below the seat and no portion of the horizontal member of the first sled member may extend rearwardly of the lower rear edge of the seat in some embodiments of the chair. For such embodiments, the rear vertical member of the second sled member may also be positioned below the seat and no portion of the horizontal member of the second sled member may extend rearwardly of the lower rear edge of the seat.

In other embodiments of our chair, the chair includes a base, a seat supported by the base, and a tablet supported by the base. The seat has a front edge and a rear edge. The rear edge is lower than the front edge. The seat also has a curved portion between the rear edge and the front edge. The curved portion of the seat extends upwards from the rear edge of the seat to define a curved surface of the seat. The tablet is above and forward of the seat and has an upper front edge, a bottom rear edge, and a curved portion between the front edge of the tablet and the bottom rear edge of the tablet. The curved portion of the tablet extends upwardly from the rear bottom edge of the tablet to a position adjacent to a front portion of the tablet to define a curved surface of the tablet. In some embodiments of this chair, the tablet is molded or formed as a unitary structure and the seat is molded or formed as a unitary structure.

A method of using a chair is also provided. The method includes the step of providing a chair that includes a base, a seat supported by the base, and a tablet supported by the base. The tablet may be above and forward of the seat and the tablet may have an upper front edge, a bottom rear edge, and a curved portion between the front edge and the bottom rear edge. The curved portion of the tablet may extend upwardly from adjacent the rear bottom edge to a position adjacent to a front portion of the tablet. The method may also include the steps of sitting on the seat of the chair in a first sitting position such that a chest of a seated user faces toward the tablet and sitting on the chair in a second sitting position such that a back of the seated user engages the curved portion of the tablet. It should be understood that embodiments of the method may be configured so that an embodiment of our chair is used when practicing the method.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the chair are shown in the accompanying drawings. It should be appreciated that like reference numbers used in the drawings may identify like components.

DETAILED DESCRIPTION OF PRESENT PREFERRED EMBODIMENTS

Figure 1:
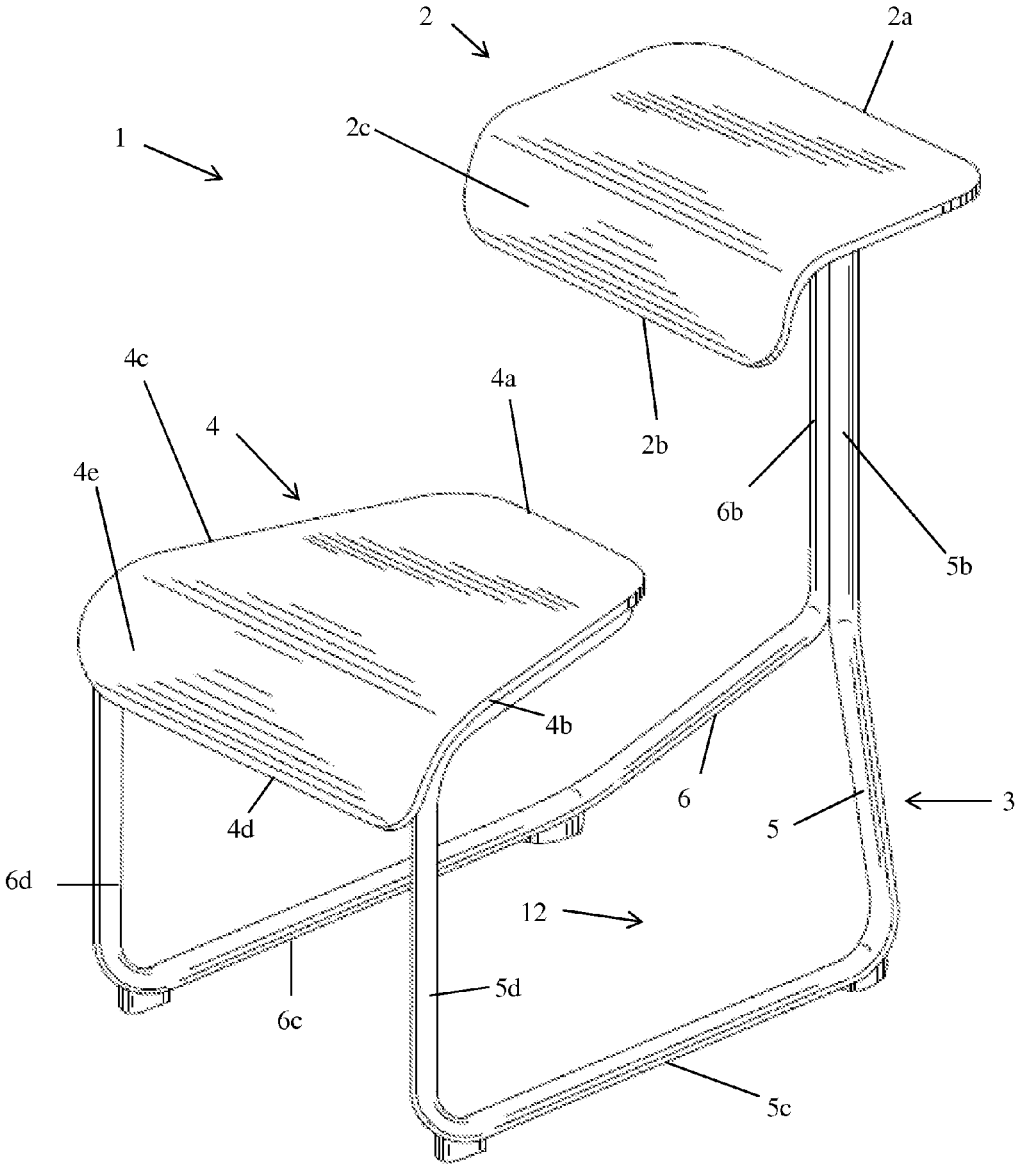
FIG. 1 is a perspective view of a first present preferred embodiment of a chair.
Figure 2:
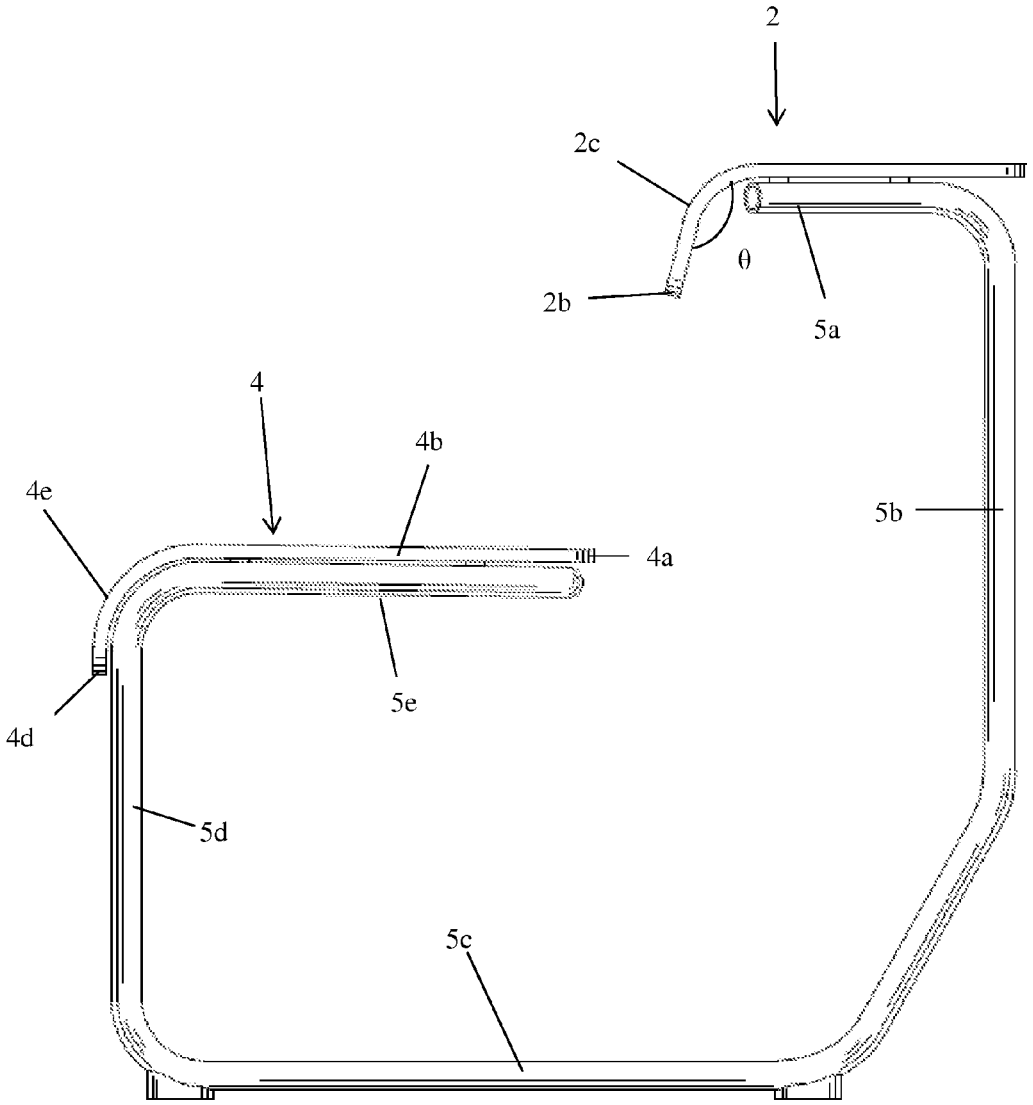
FIG. 2 is a side view of the first present preferred embodiment of the chair.
Figure 3:
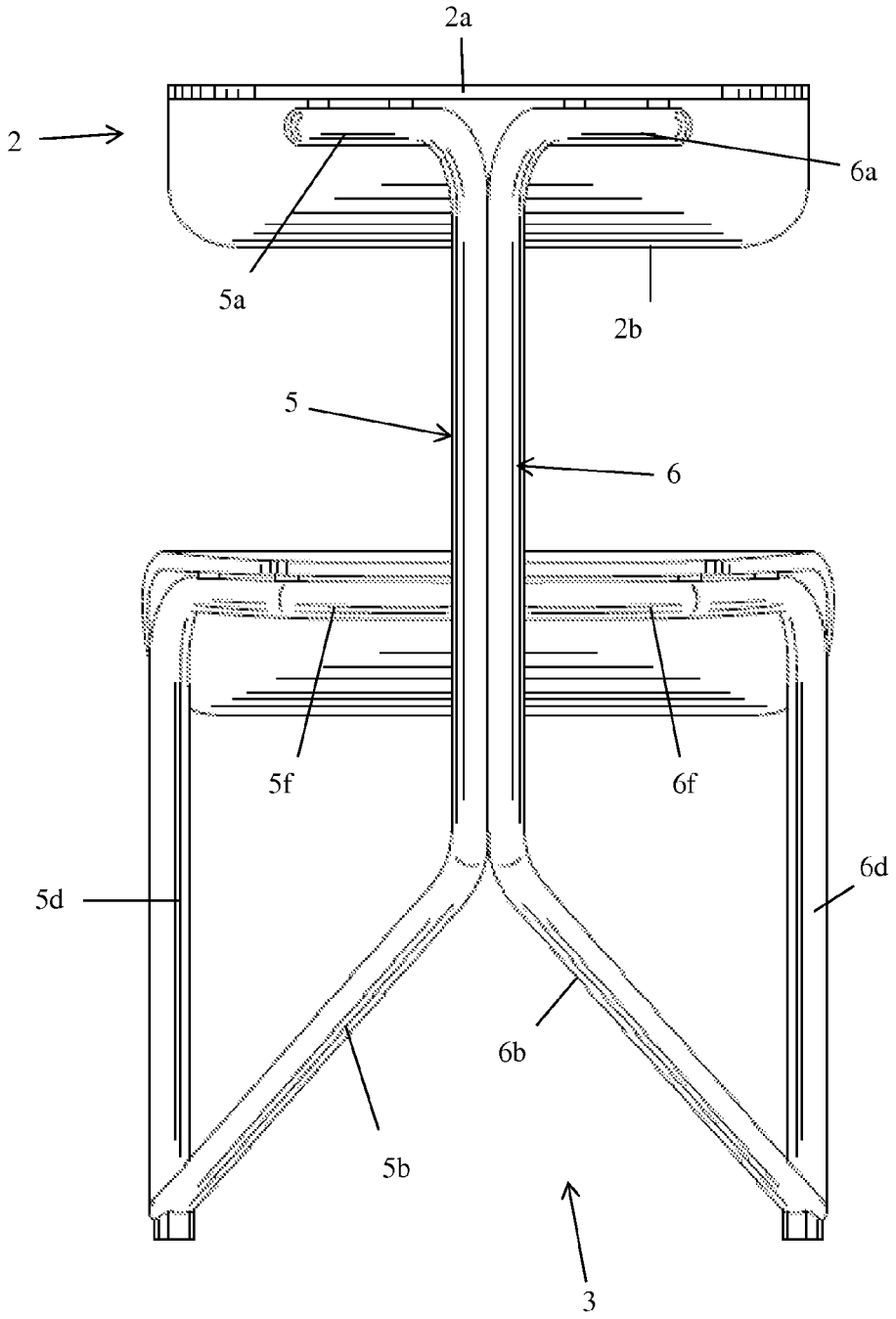
FIG. 3 is a front view of the first present preferred embodiment of the chair.
Figure 4:
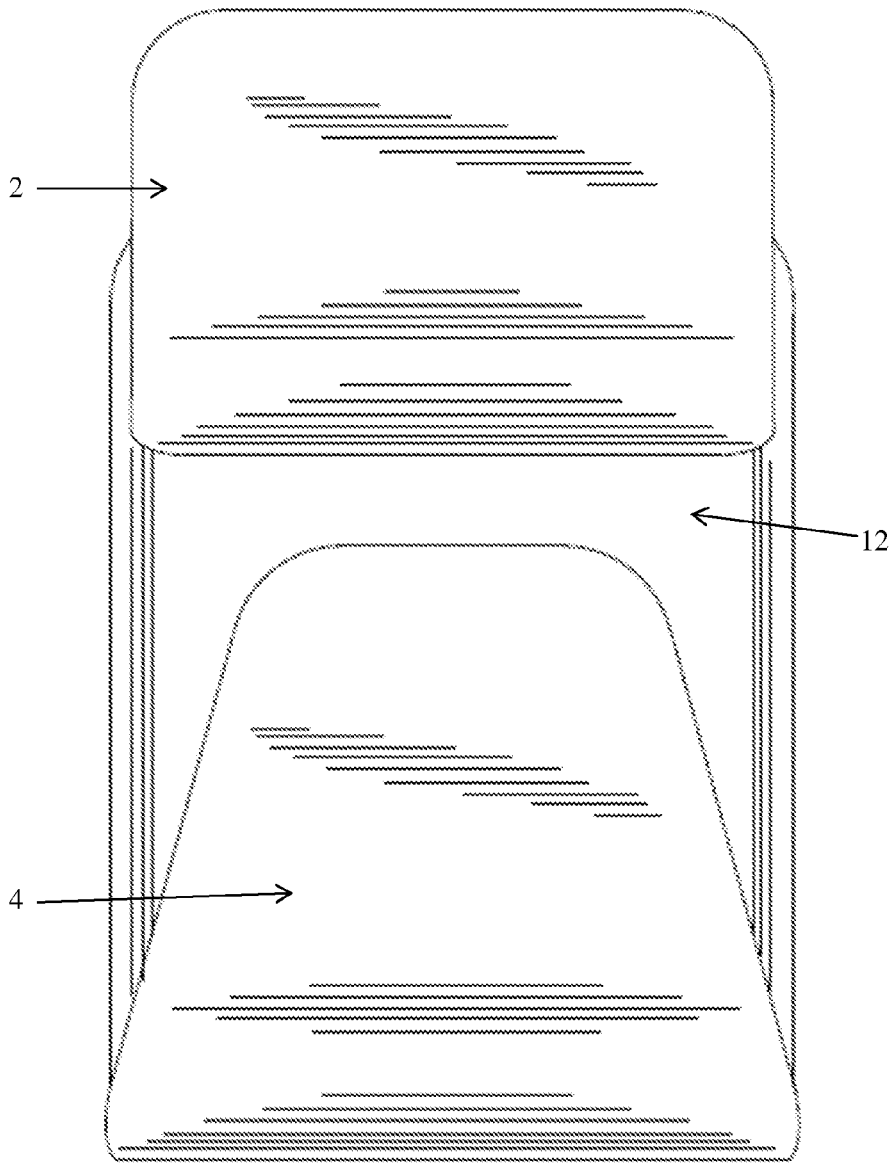
FIG. 4 is a top view of the first present preferred embodiment of the chair.
Figure 5:
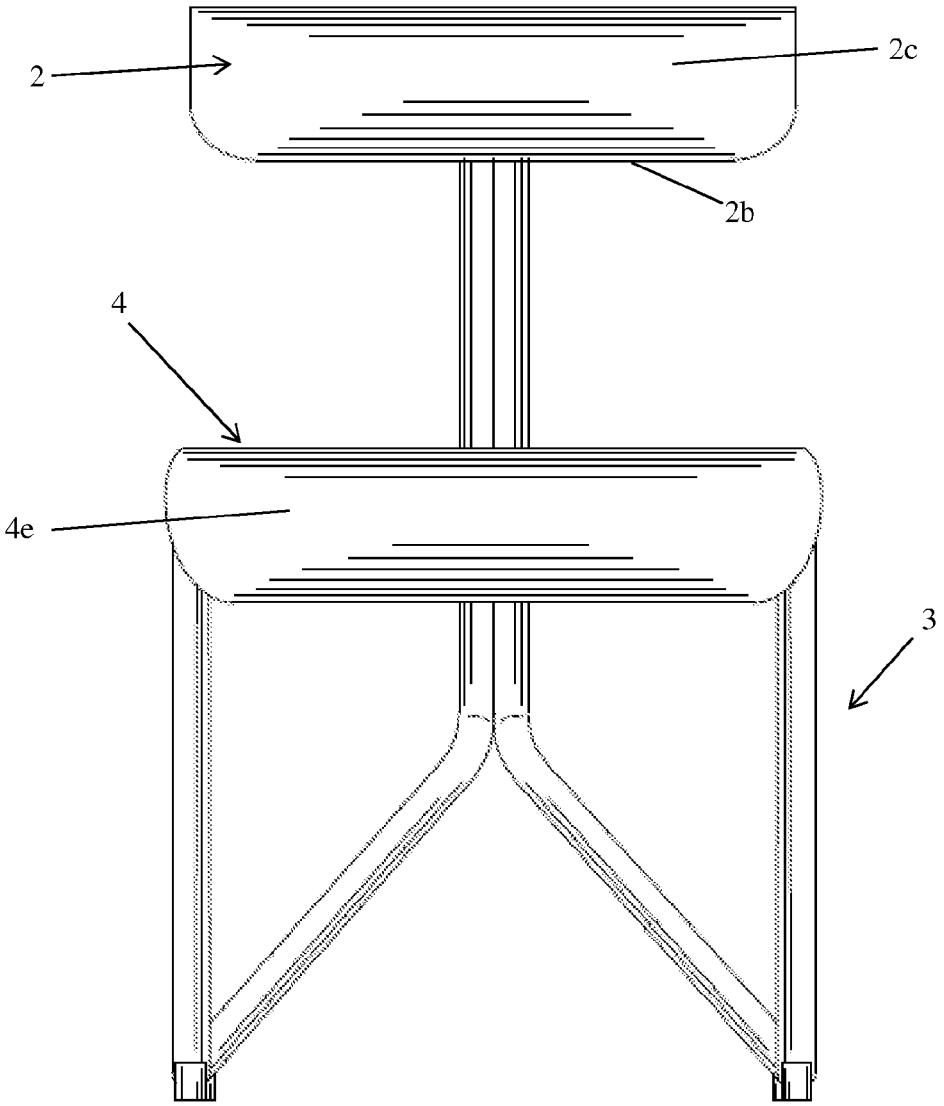
FIG. 5 is a rear view of the first present preferred embodiment of the chair.
Figure 6:
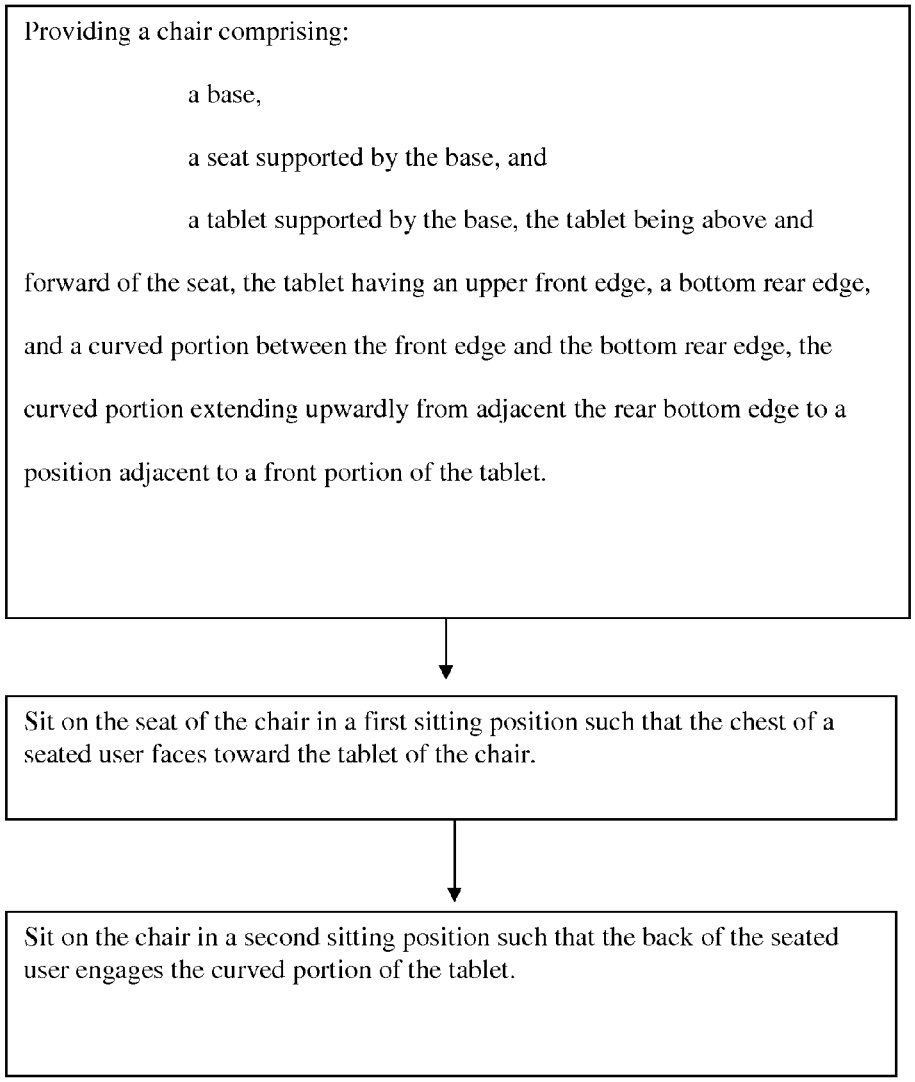
FIG. 6 is a flow chart illustrating one embodiment of a method of using the chair.

Referring to FIGS. 1-5, a chair 1 includes a tablet 2 supported by a base 3. The base 3 also supports a seat 4 that is positioned below and behind the tablet 2. The base 3 includes a first sled member 5 and a second sled member 6. The sled members may be relatively rigid members that have vertically extending portions that extend from elongated horizontal portions configured to rest on the floor or ground. The sled members may be composed of aluminum, steel, or another kind of metal. It is contemplated that the sled members could also be composed of wood or a polymeric material such as a plastic material.

In some embodiments the sled members 5 and 6 may be tubular members that have different tubular segments interconnected to each other via welding or a fastening connection mechanism such as the use of mating threads for attaching immediately adjacent segments or one or more other types of connection mechanisms such as via fasteners, brackets, or other fastening devices. In other embodiments each sled member or both sled members may be formed as a unitary structure. For instance, each sled member may be cast or molded as a unitary structure to have a desired shape or structure or the sled members may be cast or molded to have a desired shape or structure.

The first sled member 5 includes an upper tablet support portion 5*a* that is connected to a first vertically extending portion 5*b*. The first vertically extending portion 5*b* is connected to a horizontally extending portion 5*c* that is configured for engaging the ground or a floor for supporting the seat 4 and tablet 2. A second vertically extending portion 5*d* is attached to a lateral seat supporting portion 5*e*, which is attached to or in engagement with a first side of the seat 4. A front seat supporting portion 5*f* may extend from the lateral seat supporting portion 5*e* as well and be positioned for attachment to or engagement with a bottom front portion of the seat 4.

The second sled member 6 has a first portion 6*a* that supports the tablet 2. A first vertical portion 6*b* extends from the first portion 6*a* to a horizontally extending portion 6*c*. The horizontally extending portion 6*c* is also attached to a second vertically extending portion 6*d*. The second vertically extending portion 6*d* is attached to a seat supporting portion 6*e*. The lateral seat supporting portion 6*e* is adjacent a second side of the seat that is opposite the first side of the seat. The lateral seat supporting portion 6*e* is attached to or in engagement with the second side of the seat 4. A front seat supporting portion 6*f* may extend from the lateral seat supporting portion 6*e* as well for attachment to or engagement with a bottom front portion of the seat 4. The front seat supporting portion 6*f* may be attached to or integral with the front seat supporting portion 5*f* of the first sled member 5 as well.

The tablet 2 defines a work surface that includes a front surface that extends from a front edge 2*a* to a bottom edge 2*b*. The front portion of the tablet 2 may be substantially flat or may be a planar surface that is inclined. It is also contemplated that embodiments of the chair may utilize a tablet that is configured so that the front portion of the tablet has a declined surface.

A curved portion 2*c* of the tablet defines a curved surface that is positioned between the rear bottom edge 2*b* of the tablet surface and the upper front edge 2*a*. The curved portion 2*c* of the tablet 2 extends upwardly along a curve from the rear bottom edge 2*b* to define a curved surface. The curve along which the curved portion 2*c* may extend is preferably at an angle θ relative to vertical. The angle θ is preferably between 0° and 15°, but could be at other angles such as over 15°. The curved portion 2*c* is preferably curved such that the curved portion 2*c* that extends to the bottom edge 2*b* defines a curved back supporting surface as may be appreciated from a more detailed discussion of rearward sitting options afforded by the chair 1.

The tablet 2 is supported by the base 3. For example, the bottom of the tablet may be affixed or attached to the tablet supporting portions 5*a* and 6*a* of the first and second sled members 5, 6. For instance, at least one bracket or other connector may be used to attach the tablet to the tablet supporting portions of the sled members. Alternatively, the sled members may include recesses for receiving portions of the tablet to hold the tablet. As yet another alternative, the tablet may be adhered or welded to the tablet supporting portions 5*a* and 6*a* of the first and second sled members. Combinations of such connection mechanisms may also be utilized for attaching the tablet 2 to the first and second sled members 5, 6.

The seat 4 may include a front portion that includes a front edge 4*a*. The seat 4 may extend from the front edge 4*a* to the bottom rear edge 4*d*. The front portion of the seat 4 may define a seating surface that is horizontal or may be inclined or declined. For instance, the front portion may be positioned so that the seating surface provided by the front portion of the seat is at a 1° incline (e.g. one degree above horizontal) or a 1° decline (e.g. one degree below horizontal). The degree of inclination or declination of the front portion of the seat 4 may be any of a number of suitable configurations, and is preferably within a range of a 10° incline and a 10° decline.

The seat 4 also has a first side 4*b* and a second side 4*c* opposite the first side 4*b*. A curved portion 4*e* of the seat is positioned between the rear bottom edge 4*d* and the front edge 4*a*. The curved portion 4*e* extends upwardly from the bottom edge 4*d* and is adjacent to the front portion of the seat 4. The curved portion 4*e* may be integral with this front portion and may be immediately adjacent to the front portion of the seat.

The curved portion 4*e* of the seat 4 may define a curved surface sized and configured to support a portion of a user's legs, such as a user's thighs, if a user sits so that their chest faces away from the tablet 2 or their back rests against the curved portion 2*c* of the tablet 2. A portion of the user's legs may therefore engage the curved portion 2*c* when rearwardly sitting on the seat 4 so that the user's back engages the curved portion 2*c* of the tablet 2 or faces the tablet 2.

In some embodiments, the curved portion 4*e* may be configured so that it provides no support to a user that is seated so that their chest faces the tablet 2 and feet are below the tablet 2. Such embodiments may be configured so that the curved surface defined by the curved portion 4*e* of the seat 4 engages the rear surface of a user's legs or contacts the rear surface of the user's legs only if the user sits so that their back faces toward the tablet or engages the curved portion 2*c* of the tablet 2 (e.g. rests upon, touches, contacts or is supported by the curved portion 2*c*).

The seat 4 is supported by the base 3. The seat supporting portions 5*e* and 6*e* of the first and second sled members may contact or engage the bottom of the seat to support the seat. Alternatively, the seat supporting portions 5*e* and 6*e* may be attached via a bracket or other connector to the seat 4 or may be welded or adhered to the seat 4. The front seat supporting portions 5*f* and 6*f* may also be in engagement with the bottom of the seat 4 or may alternatively be attached via a connector, welding, an adhesive, or other fastening mechanism to support the seat 4. Of course, alternative embodiments may utilize combinations of such connection mechanisms for attaching the seat 4 to sled members or other components of a base 3 of the chair.

The curved portions of the tablet 2 and seat 4 may be configured to help permit a user to sit at least two different ways on the chair 1. In a first sitting posture, or seated position, a user may sit so that their feet are positioned below the tablet 2 and their chest faces toward the tablet 2. Such a posture is a typical posture for a person sitting in a tablet chair. The front vertically extending portions 5*b* and 6*b* of the sled members and the horizontally extending members 5*c* and 6*c* may be shaped and configured to be spaced apart for defining a space 12 or opening below the tablet and between the horizontally extending portions 5*c* and 6*c*. The user's feet may be placed in this defined space 12 below the tablet when in the first seated position.

The chair 1 is also configured to permit a user to comfortably turn around and sit in another position. In the second sitting posture, or seated position, the user's legs extend from the rear of the seat and the user's back faces toward the tablet 2. The user's back may engage or rest upon the curved portion 2*c* of the tablet 2 and the user's thighs or upper portion of the user's legs may be supported by the curved portion 4*e* of the seat as well. In this way, the curved portion 2*c* of the tablet may provide back support to a user and the seat may be configured to provide a comfortable seating surface to the user when in the second seated position. In the second seated position, a user may be free to easily fold one leg over the other, kick his or her feet, or make other casual seated movements with their feet or lower legs.

The user may twist his or her body so that the user is able to move from the first sitting posture to the second sitting posture and vice versa without having to stand up (e.g. he or she may twist or rotate on the seat to adjust his or her position). In moving from the first sitting posture to the second sitting posture and vice versa, the user may have his or her legs extend off the side of the seat and away from the tablet. In yet alternative embodiments of a method of changing seated positions or sitting postures, it should be understood that the user may stand up to adjust his or her position as well.

The multiple different sitting positions are actively supported by the chair so that a user may utilize the chair comfortably in multiple positions. It is contemplated that the first seated position may be preferable for seating used in educational settings or instructional settings where a user may want to take notes or work on a laptop, internet appliance, or electronic tablet or need to refer to one or more books, such as text books. It is contemplated that the second seated position may be preferable for seating used in collaborative settings such as brain storming sessions or design collaboration meetings or other meetings or conferences in which the work surface provided by the tablet may not be needed.

It is also contemplated that the front portion of the tablet 2 forward of the curved portion 2*c* may be flat so that the front portion can be used to store a back, briefcase, or books that are not needed for reference when a user sits in the second seated position. Thus, the tablet may still offer a desired structure or functionality even when not used as a work surface. In contrast, when a user sits in the chair in the first seated position, the front portion of the tablet 2 may still provide a work surface for supporting a laptop or book, support note taking, or otherwise help facilitate the performance of work.

It should be appreciated that embodiments of the chair may utilize many different features. For example, the seat 4 may be a unitary structure composed of polymeric material or may be a structure that has many interconnected components, such as a foam member that is positioned between a fabric or leather covering and a rigid plate. For instance, the covering may be a fabric or mesh material that is sewn, adhered or otherwise attached to the rigid plate to enclose the foam member, such as a foam cushion. The tablet 2 may be composed of wood, metal, a composite material, a polymeric material or other material. The tablet 2 may be composed of interconnected members or be formed as a unitary structure. For instance, the tablet may be a wood member that includes a laminate surface or treated surface or may be a polymeric sheet or plate that is formed to include the curved portion 2*c* as being integral with the front portion of the tablet 2. As yet another example, it should be appreciated that the shape and configuration of the base 3 may be any of a number of different configurations needed to meet a particular design objective that permit the base to support both the seat 4 and the tablet 2.

Therefore it should be understood that while certain present preferred chairs and methods of making and using chairs have been discussed and illustrated herein, it is to be distinctly understood that the invention is not limited thereto but may be otherwise variously embodied and practiced within the scope of the following claims.

What is claimed is:

1. A chair comprising:

a base;

a seat supported by the base; and a tablet supported by the base, the tablet being above and forward of the seat, the tablet having an upper front edge, a bottom rear edge, and a curved portion between the front edge and the bottom rear edge, the rear bottom edge being lower than the front edge, the curved portion extending upwardly from adjacent the rear bottom edge to a position adjacent to a front portion of the tablet to define a curved upper surface of the tablet that extends upwardly from the bottom rear edge of the tablet to a position adjacent the front portion of the tablet, the front portion of the tablet being forward of the curved upper surface, the front portion of the tablet defining an upper horizontal flat surface extending from adjacent the curved upper surface to the front edge of the tablet.

2. The chair of claim 1 wherein the seat has a front edge and a rear edge, the rear edge of the seat being lower than the front edge of the seat.

3. The chair of claim 2 wherein the seat also has a curved portion between the rear edge of the seat and the front edge of the seat, the curved portion of the seat extending upwards from the rear edge of the seat to define a curved upper surface of the seat.

4. The chair of claim 3 wherein the front portion of the seat extends from the curved upper surface of the seat to the front edge of the seat, the front portion of the seat defining a horizontal upper surface or an inclined upper surface that is inclined at an angle of more than 0° and less than 10°, the horizontal upper surface or the inclined upper surface of the seat being in front of the curved upper surface of the seat.

5. The chair of claim 1 wherein the base is comprised of at least one sled member.

6. The chair of claim 1 wherein the base is comprised of a first sled member and a second sled member, the first and second sled members supporting both the seat and the tablet.

7. The chair of claim 6 wherein the first sled member has:

a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a first side of the seat or attachment to the first side of the seat; and wherein the second sled member has:

a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a second side of the seat or attachment to the second side of the seat, the second side of the seat being opposite the first side of the seat.

8. The chair of claim 7 wherein the horizontal and front vertical members of the first and second sled members are sized and configured to define space between the horizontal and front vertical members of the first and second sled members, the space being sized and configured to provide an opening for a user's feet when the user sits on the seat so that a chest of the user faces toward the tablet.

9. The chair of claim 8 wherein the rear vertical member of the first sled member is positioned below the seat and no portion of the horizontal member of the first sled member extends rearwardly of the lower rear edge of the seat; and wherein the rear vertical member of the second sled member is positioned below the seat and no portion of the horizontal member of the second sled member extends rearwardly of the lower rear edge of the seat.

10. A method of using a chair comprising:

providing a chair, the chair comprising:

a base, a seat supported by the base, and a tablet supported by the base, the tablet being above and forward of the seat, the tablet having an upper front edge, a bottom rear edge, and a curved portion between the front edge and the bottom rear edge, the front edge of the tablet being above the bottom rear edge of the tablet, the curved portion extending upwardly from adjacent the rear bottom edge to a position adjacent to a front portion of the tablet, the front portion of the tablet defining a horizontal flat upper surface of the tablet, the horizontal flat upper surface of the front portion of the tablet extending from a forward end of the curved portion to the front edge of the tablet;

sitting on the seat of the chair in a first sitting position such that a chest of a seated user faces toward the tablet; and sitting on the seat of the chair in a second sitting position such that a back of the seated user engages the curved portion of the tablet, the curved portion of the tablet being configured to support to the back of the seated user engaging the curved portion of the tablet.

11. The method of claim 10 wherein the seat has a front edge and a rear edge, the rear edge of the seat being lower than the front edge of the seat.

12. The method of claim 11 wherein the seat also has a curved portion between the rear edge of the seat and the front edge of the seat, the curved portion of the seat extending upwards from the rear edge of the seat to define a curved surface of the seat, an upper portion of legs of a user engaging the curved surface of the seat when the user is seated in the second sitting position.

13. The method of claim 12 wherein the upper portion of the legs are comprised of thighs, and wherein the thighs are supported by the curved surface of the seat when sitting on the seat of the chair in the second position and wherein the curved portion of the tablet extends from the rear bottom edge of the tablet to the front portion of the tablet to define a curved upper surface of the tablet, the front portion of the tablet being forward of the curved upper surface, the front portion of the tablet defining the horizontal flat upper surface that extends from adjacent the curved upper surface to the front edge of the tablet.

14. The method of claim 10 wherein the base is comprised of at least one sled member.

15. The method of claim 10 wherein the base is comprised of a first sled member and a second sled member, the first and second sled members supporting both the seat and the tablet.

16. The method of claim 15 wherein the first sled member has:

a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a first side of the seat or attachment to the first side of the seat; and wherein the second sled member has:

a tablet supporting portion for engaging or attachment to the tablet, a front vertical member extending from the tablet supporting portion, a horizontal member extending from the front vertical member to a rear vertical member, and a lateral seat supporting portion extending from the rear vertical member for engaging a second side of the seat or attachment to the second side of the seat; and the second side of the seat being opposite the first side of the seat.

17. The method of claim 16 wherein the horizontal and front vertical members of the first and second sled members are sized and configured to define an opening between the horizontal and front vertical members of the first and second sled member, the opening being sized and configured to provide space for a user's feet when the user sits on the seat in the first seated position so that a chest of the user faces toward the tablet.

18. The method of claim 17 wherein the rear vertical member of the first sled member is positioned below the seat and no portion of the horizontal member of the first sled member extends rearwardly of the lower rear edge of the seat; and wherein the rear vertical member of the second sled member is positioned below the seat and no portion of the horizontal member of the second sled member extends rearwardly of the lower rear edge of the seat.

19. A chair comprising:

a base;

a seat supported by the base, the seat having a front edge and a rear edge, the rear edge of the seat being lower than the front edge of the seat, the seat also having a curved portion between the rear edge of the seat and the front edge of the seat, the curved portion of the seat extending upwards from the rear edge of the seat to define a curved surface of the seat; and a tablet supported by the base, the tablet being above and forward of the seat, the tablet having an upper front edge, a bottom rear edge, and a curved portion between the front edge of the tablet and the bottom rear edge of the tablet, the bottom rear edge of the tablet being lower than the front edge of the tablet, the curved portion of the tablet extending upwardly from the rear bottom edge of the tablet to a position adjacent to a front portion of the tablet to define a curved surface of the tablet that extends upwardly from the bottom rear edge of the tablet to a position adjacent the front portion of the tablet the front portion of the tablet being forward of the curved upper surface, the front portion of the tablet defining an upper horizontal flat surface extending from adjacent the curved upper surface to the front edge of the tablet.

20. The chair of claim 19 wherein the tablet is molded or formed as a unitary structure and the seat is molded or formed as a unitary structure.

* * * * *